US011713734B1

(12) United States Patent
Kou et al.

(10) Patent No.: US 11,713,734 B1
(45) Date of Patent: Aug. 1, 2023

(54) THERMALLY CONDITIONED NOISE / VIBRATION ATTENUATING FUEL RAIL CHAMBER

(71) Applicant: GM GLOBAL TECHNOLOGY OPERATIONS LLC, Detroit, MI (US)

(72) Inventors: Jie Kou, Novi, MI (US); Joseph Hahn, White Lake Township, MI (US); Christopher L. Koppen, Webster, NY (US); Steven D. Burch, Honeoye Falls, NY (US); Kenneth Kurzawa, Ferndale, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 0 days.

(21) Appl. No.: 18/162,812

(22) Filed: Feb. 1, 2023

(51) Int. Cl.
*F02M 21/02* (2006.01)
*F02M 21/06* (2006.01)

(52) U.S. Cl.
CPC .... *F02M 21/0206* (2013.01); *F02M 21/0227* (2013.01); *F02M 21/0245* (2013.01); *F02M 21/06* (2013.01)

(58) Field of Classification Search
None
See application file for complete search history.

(56) References Cited

U.S. PATENT DOCUMENTS

| | | | | |
|---|---|---|---|---|
| 7,592,083 | B2 * | 9/2009 | Meltser | H01M 8/04149 429/411 |
| 2007/0082242 | A1 * | 4/2007 | Meltser | H01M 8/04149 429/444 |
| 2012/0216915 | A1 * | 8/2012 | Takata | F28D 7/14 141/82 |
| 2016/0211534 | A1 * | 7/2016 | Ono | H01M 8/04074 |
| 2021/0111417 | A1 * | 4/2021 | Shimotori | H01M 8/0267 |

FOREIGN PATENT DOCUMENTS

| | | | | |
|---|---|---|---|---|
| AU | 2012316497 | A1 * | 4/2014 | F02D 19/0647 |
| CA | 2368895 | C * | 6/2010 | H01M 8/0258 |
| CA | 2540326 | C * | 2/2011 | B60L 58/30 |
| CA | 2776739 | A1 * | 4/2011 | F17C 5/06 |
| CA | 3103201 | A1 * | 7/2020 | H01M 8/0258 |
| CN | 105119005 | A * | 12/2015 | |
| CN | 212461747 | U * | 2/2021 | |
| CN | 113803635 | A * | 12/2021 | |

(Continued)

*Primary Examiner* — Kevin R Steckbauer
(74) *Attorney, Agent, or Firm* — Quinn IP Law

(57) ABSTRACT

A multi-function fuel delivery system and method of providing fuel delivery is provided that addresses space-related and cost related challenges as well as other challenges by combining a noise attenuating function, a hydrogen heating function, and a fuel supply rail capable of supplying hydrogen to multiple injectors within a single volume where a heat-transfer core utilizes an existing available internal volume of an attenuating volume or a fuel rail of a hydrogen supply manifold. A hydrogen fuel manifold, a hydrogen heat exchanger, and a fuel rail are housed in a single chamber such that a hydrogen fuel heating/cooling function, a hydrogen fuel noise/vibration attenuating function, providing the heat to the heat-transfer core, and providing the noise-attenuated H2 are performed in the single chamber.

20 Claims, 6 Drawing Sheets

(56) References Cited

FOREIGN PATENT DOCUMENTS

| | | | | | |
|---|---|---|---|---|---|
| CN | 114234036 | A | * | 3/2022 | |
| CN | 215988854 | U | * | 3/2022 | |
| CN | 217004897 | U | * | 7/2022 | |
| CN | 115136366 | A | * | 9/2022 | ..... H01M 8/0263 |
| DE | 102006047176 | B4 | * | 2/2018 | ..... H01M 8/04149 |
| DE | 112019006607 | T5 | * | 9/2021 | ..... H01M 8/0258 |
| DE | 102021109017 | A1 | * | 12/2021 | ..... B01D 46/0036 |
| DE | 102021109017 | B4 | * | 3/2023 | ..... B01D 46/0036 |
| EP | 2487401 | A1 | * | 8/2012 | ..... F17C 5/06 |
| FR | 3112574 | A1 | * | 1/2022 | |
| JP | 3443276 | B2 | * | 9/2003 | ..... F28B 1/06 |
| JP | 3835368 | B2 | * | 10/2006 | |
| JP | 2009298196 | A | * | 12/2009 | ..... B60K 1/04 |
| JP | 2011080495 | A | * | 4/2011 | ..... F17C 5/06 |
| JP | 4954375 | B2 | * | 6/2012 | ..... H01M 8/0258 |
| JP | 2016031180 | A | * | 3/2016 | |
| JP | 2017183134 | A | * | 10/2017 | |
| JP | 2017183135 | A | * | 10/2017 | |
| JP | 2017183137 | A | * | 10/2017 | |
| JP | 2017183138 | A | * | 10/2017 | |
| JP | 6226832 | B2 | * | 11/2017 | |
| JP | 2020095979 | A | * | 6/2020 | |
| JP | 2020098804 | A | * | 6/2020 | |
| JP | 6768328 | B2 | * | 10/2020 | |
| JP | 6771924 | B2 | * | 10/2020 | |
| JP | 6771925 | B2 | * | 10/2020 | |
| JP | 6848104 | B2 | * | 3/2021 | |
| JP | 7102358 | B2 | * | 7/2022 | ..... H01M 8/0258 |
| RU | 2283454 | C1 | * | 9/2006 | ..... F17C 11/005 |
| WO | WO-2011043308 | A1 | * | 4/2011 | ..... F17C 5/06 |
| WO | WO-2018040305 | A1 | * | 3/2018 | ..... H01M 8/04014 |
| WO | WO-2021165994 | A1 | * | 8/2021 | ..... H01M 8/0263 |

* cited by examiner

THERMALLY CONDITIONED NOISE / VIBRATION ATTENUATING FUEL RAIL CHAMBER

INTRODUCTION

The present disclosure is related to fuel delivery systems. Specifically, the present disclosure is related to hydrogen (H2) fuel delivery systems.

Some fuel rail chambers utilize a separate H2 supply chamber, a multi-injector fuel rail and a heat exchanger. Although pulsed-type H2 injectors may provide precise control of fuel delivery to H2 fuel cell systems and H2 combustion engines, noise and pressure pulsation from sudden opening and closing operations of the pulsed-type injectors create noise and vibration in devices, such as a ground vehicle, an airplane or a power generator, in which the chambers are utilized.

An H2 manifold, usually with a sizable internal volume may be utilized upstream of the pulsed-type H2 injectors to reduce noise and vibration. Furthermore, an anode heat exchanger may be utilized to warm cold H2 from thermal systems in order to mitigate low temperature risks of the cold H2 to Proton-Exchange Membrane (PEM) Fuel cell systems and combustion engines, such as icing of seals during freezing conditions and excessive water condensation in the fuel stack that impacts fuel cell electrochemical reaction performance.

However, utilizing separate volumes to provide the various functions has space-related and cost related challenges as well as other challenges. The present disclosure addresses these issues, as well as others, by providing a system that combines a noise attenuating function, an H2 heating function, and a fuel supply rail capable of supplying H2 to multiple injectors with all three performed within a single volume. The heat-transfer core according to the present disclosure utilizes an existing available internal volume of an attenuating volume or a fuel rail of the H2 supply manifold.

SUMMARY

The present disclosure provides a multi-function fuel delivery system. The present disclosure also provides a method of providing fuel delivery.

The fuel delivery system includes an H2 heat exchanger receiving cold H2 and performing an H2 fuel heating/cooling function, an H2 fuel manifold, in which the H2 heat exchanger is housed, receiving H2 heated by the H2 heat exchanger and performing an H2 fuel noise/vibration attenuating function to reduce vibration noise, and a fuel rail receiving H2 noise-attenuated by the H2 fuel manifold and providing the noise-attenuated H2 simultaneously to a plurality of injectors. The H2 fuel manifold further includes at least one coolant flow path providing heat to at least one heat-transfer core. The H2 heat exchanger, the H2 fuel manifold, and the fuel rail are housed in a single chamber.

The fuel delivery system may further include a plurality of modular heat-transfer cores, where a number and layout of the plurality of modular heat-transfer cores is variable to provide different amounts of heat transfer. The plurality of modular heat-transfer cores may each include a plurality of variable modular fins to provide the different amounts of heat transfer and the at least one coolant flow path may have variable dimensions to provide the different amounts of heat transfer.

The at least one coolant flow path may be geometrically shaped for optimized performance to enhance heat transfer of coolant to the H2 heat exchanger. The at least one coolant flow path may be included in a side wall of the chamber.

The at least one coolant flow path may be included in the H2 fuel manifold and the H2 fuel manifold may be attached to a side wall of the chamber. The H2 heat exchanger may include a cold/hot plate to perform the heating/cooling function.

The fuel delivery system may be a heated fuel rail attenuating volume (HFRAV). A heating/cooling capacity of the H2 heat exchanger may be independent of a noise/vibration attenuating capacity of the H2 fuel manifold. A noise/vibration attenuating volume of the H2 fuel manifold may be shared with an H2 heat-transfer flow field of flow channels for heat transfer.

The method includes receiving cold H2 and performing an H2 heating/cooling function, performing an H2 fuel noise/vibration attenuating function on heated H2 to reduce vibration noise, providing heat to a heat-transfer core via at least one coolant flow path, and providing the noise-attenuated H2 simultaneously to a plurality of injectors. The H2 fuel heating/cooling function, the H2 fuel noise/vibration attenuating function, providing the heat to the heat-transfer core, and providing the noise-attenuated H2 are performed in a single chamber.

The method may further include varying a number and layout of a plurality of modular heat-transfer cores to provide different amounts of heat transfer. Providing the different amounts of heat transfer may include varying a number of a plurality of modular fins and varying dimensions of the at least one coolant flow path.

The at least one coolant flow path may be geometrically shaped for optimized performance to enhance heat transfer of coolant to the H2 heat exchanger. The method may further include providing the at least one coolant flow path in a side wall of the chamber.

The method may further include providing the at least one coolant flow path in an H2 fuel manifold that is attached to a side wall of the chamber. The H2 heating/cooling function may include controlling a cold/hot plate.

The H2 heating/cooling function may be performed independent of the noise/vibration attenuating function. The noise/vibration attenuating function may share an H2 heat-transfer flow field of flow channels for heat transfer.

The above summary is not intended to represent every embodiment or every aspect of the present disclosure. Rather, the foregoing summary merely provides an exemplification of some of the novel concepts and features set forth herein. The above features and advantages, and other features and advantages, will be readily apparent from the following detailed description of illustrated embodiments and representative modes for carrying out the disclosure when taken in connection with the accompanying drawings and appended claims. Moreover, the present disclosure expressly includes any and all combinations and sub-combinations of the elements and features presented previously and subsequently.

Figure 1:
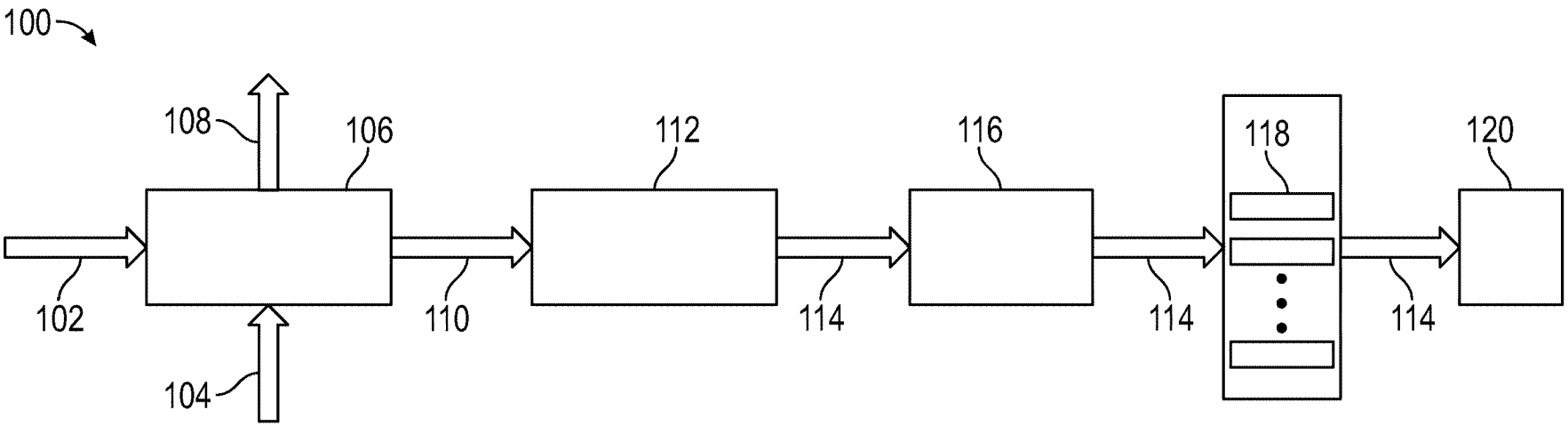
FIG. 1 illustrates a schematic diagram of a possible implementation of a fuel delivery system.

The present disclosure may be extended to modifications and alternative forms, with representative embodiments illustrated in the drawings and disclosed in detail herein. Inventive aspects of the present disclosure are not limited to the disclosed embodiments. Rather, the present disclosure is intended to cover modifications, equivalents, combinations, and alternatives falling within the scope of the disclosure as defined by the appended claims.

DETAILED DESCRIPTION

The following disclosure is merely exemplary in nature and is not intended to limit the present disclosure, application, or uses. It should also be understood that throughout the drawings, corresponding reference numerals indicate like or corresponding parts and features.

The present disclosure is susceptible of embodiment in many different forms. Representative examples of the disclosure are shown in the drawings and disclosed herein in detail as non-limiting examples of the disclosed principles. To that end, elements and limitations disclosed in the Abstract, Introduction, Summary, and Detailed Disclosure sections, but not explicitly set forth in the claims, should not be incorporated into the claims, singly or collectively, by implication, inference, or otherwise.

Example embodiments will now be disclosed more fully with reference to the accompanying drawings. The present disclosure relates generally to fuel delivery systems and, specifically, to H2 fuel delivery systems.

FIG. 1 illustrates a schematic diagram of a possible implementation of a fuel delivery system. As illustrated in FIG. 1, the fuel delivery system 100 is an H2 fuel delivery system and includes cold H2 input (CH2) 102 and coolant input (CLI) 104 to a heat exchange function (HEX) 106, with the HEX 106 outputting coolant (CLO) 108, warming the CH2 102 and outputting warmed CH2 102 (WH2) 110 to a noise/vibration attenuator function (NA) 112. The NA 112 performs noise/vibration attenuation on the WH2 110 to reduce noise and vibration caused by H2 pressure pulsations from injection events and provides noise-attenuated H2 (NH2) 114 to a fuel rail function (FR) 116. The FR 116 provides the NH2 114 to a plurality of injectors (INJ) 118. The INJ 118 provide the NH2 114 to a fuel cell stack (FS) 120 with a same flow rate as the flow rate of the NH2 114 input to the INJ 118 but at a reduced pressure. As further illustrated in FIG. 1, the HEX 106, NA 112, and FR 116 are provided by three separate components.

The INJ 118 in FIG. 1 are a representation of fuel pressure and fuel control devices that regulate how much NH2 114 is input to the FCS 120 to provide cell stack operating power. Alternatively, a fuel control proportional valve may be utilized.

Figure 2:
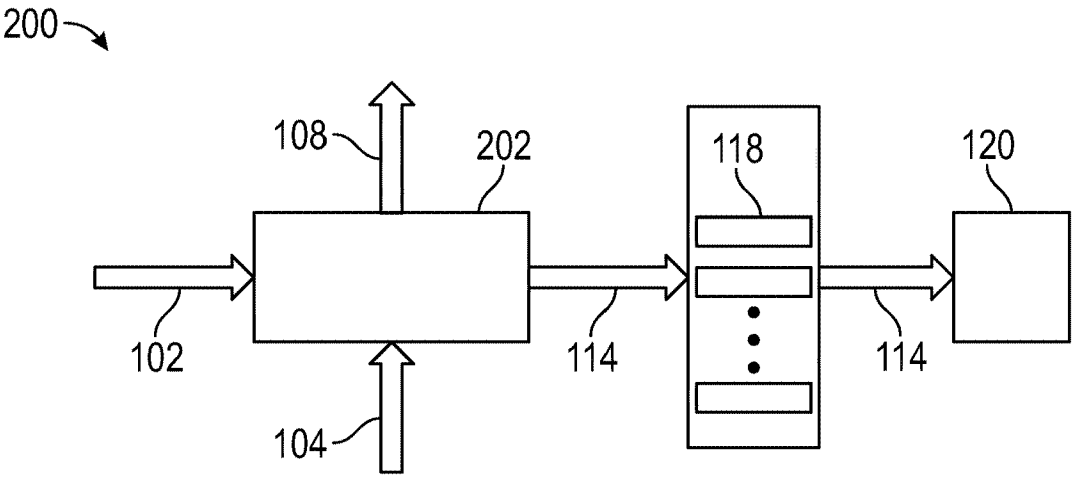
FIG. 2 illustrates a schematic diagram of an H2 fuel delivery system according to an embodiment of the present disclosure.

FIG. 2 illustrates a schematic diagram of an H2 fuel delivery system according to an embodiment of the present disclosure. As illustrated in FIG. 2, the system 200 combines the HEX 106, NA 112, and FR 116 into a single multi-functional component, specifically a heated fuel rail attenuating volume (HFRAV) 202. By virtue of the HEX 106, NA 112, and FR 116 provided by a single multi-functional component, less components are utilized in a fuel cell system or H2 combustion engine, space is saved, and potential lower costs are incurred for engineering and sourcing work.

The H2 fuel delivery system 200 of the present disclosure is a multi-function fuel delivery system. The fuel delivery system 200 may be a noise-attenuating and H2-heating multi-function chamber and may include an H2 heat exchanger that performs an H2 fuel heating/cooling function, an H2 fuel manifold that performs an H2 fuel noise/vibration attenuating function and one or more coolant flow paths that provide heat to a heat-transfer core. The fuel delivery system 200 supplies H2 fuel simultaneously to a plurality of injectors.

The H2 heat exchanger may be housed in the H2 fuel manifold and may include a cold/hot plate. A heating/cooling capacity of the H2 heat exchanger may be independent of a noise/vibration attenuating capacity of the H2 fuel manifold. A noise/vibration attenuating volume of the H2 fuel manifold may be shared with an H2 heat-transfer flow field of flow channels for heat transfer.

The fuel delivery system 200 may include multiple modular heat-transfer cores such that a number and layout of the multiple modular heat-transfer cores is variable to provide different amounts of heat transfer. The multiple modular heat-transfer cores may include a variable number of modular heat-transfer fins and allow variable coolant path dimensions to provide the different amounts of and enhance the transfer of heat.

The cores and fins are expandable such that an amount of heat transferability may be varied. The expandability of the cores and fins also enables scaling/sizing of the fuel delivery system 200 according to different internal volumes which define overall dimensions.

The one or more coolant flow paths may be geometrically shaped for optimized performance, such as sine wave-shaped, to enhance heat transfer of coolant to the H2 heat exchanger. The one or more coolant flow paths may be included in a side wall or multiple side walls of the chamber. The one or more coolant flow paths may be included in the H2 fuel manifold that is attached to a side wall of the chamber.

Figure 3A:
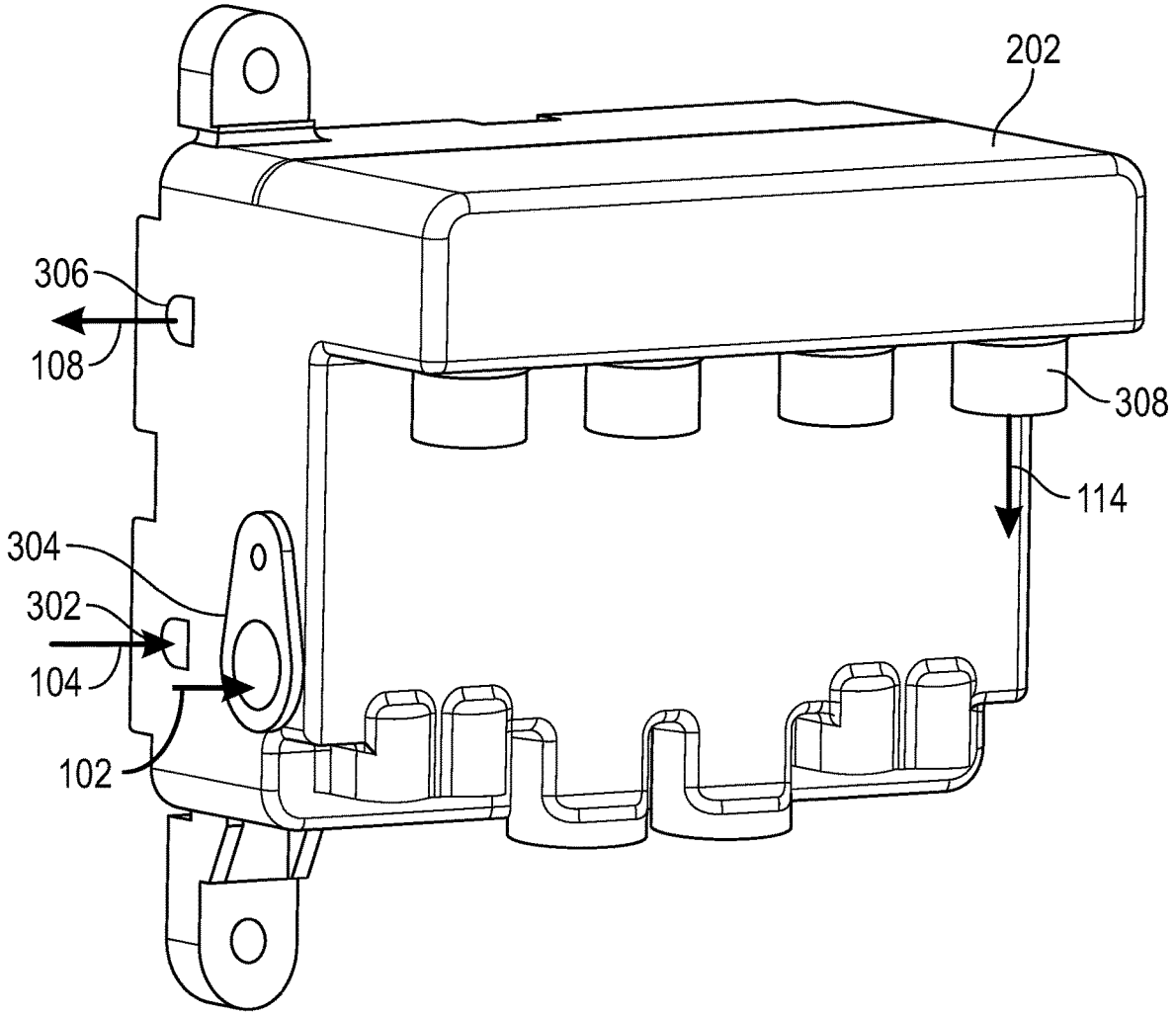
FIG. 3A illustrates a fuel rail attenuating volume according to an embodiment of the present disclosure.
Figure 3B:
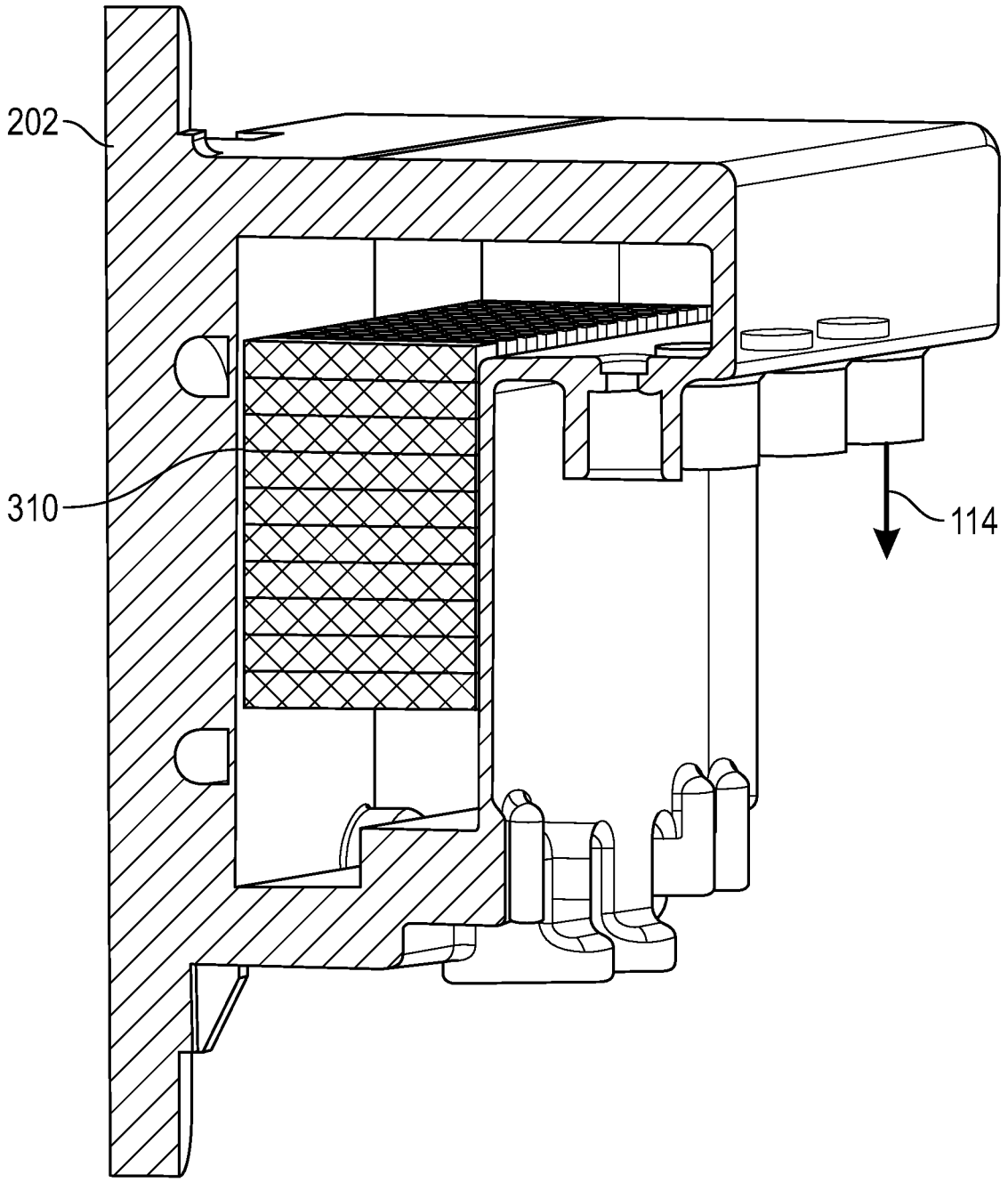
FIG. 3B illustrates a partially-open cross-sectional view of the fuel rail attenuating volume illustrated in FIG. 3A.

FIG. 3A illustrates a fuel rail attenuating volume according to an embodiment of the present disclosure. FIG. 3B illustrates a partially-open cross-sectional view of the fuel rail attenuating volume illustrated in FIG. 3A.

As illustrated in FIG. 3A and FIG. 3B, the HFRAV 202 provides inlets 302, 304 for, respectively, the CLI 104 and CH2 102 and provides outlets 306, 308 for, respectively, the CLO 108 and NH2 114. As further illustrated in FIG. 3B, the HFRAV 202 includes fins (FN) 310.

The FN 310 are the extended surfaces that increase a rate of convective heat transfer. The FN 310 are generally used when a heat transfer rate is insufficient to provide proper cooling or heating of a body. Different types of FN 310 may be utilized to optimize heat transfer for different scenarios.

Figure 3C:
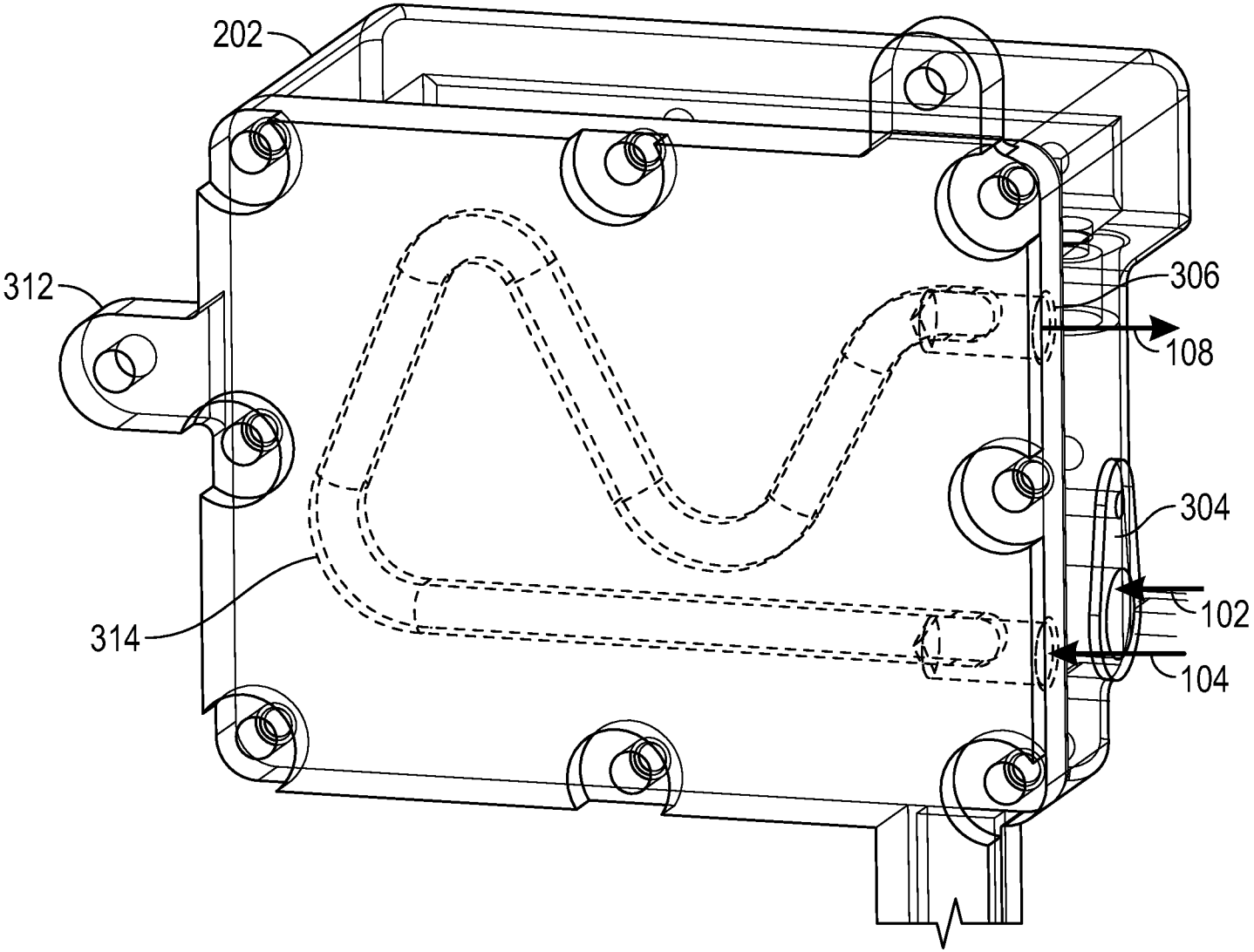
FIG. 3C illustrates a covered rear view of the fuel rail attenuating volume illustrated in FIG. 3A.
Figure 3D:
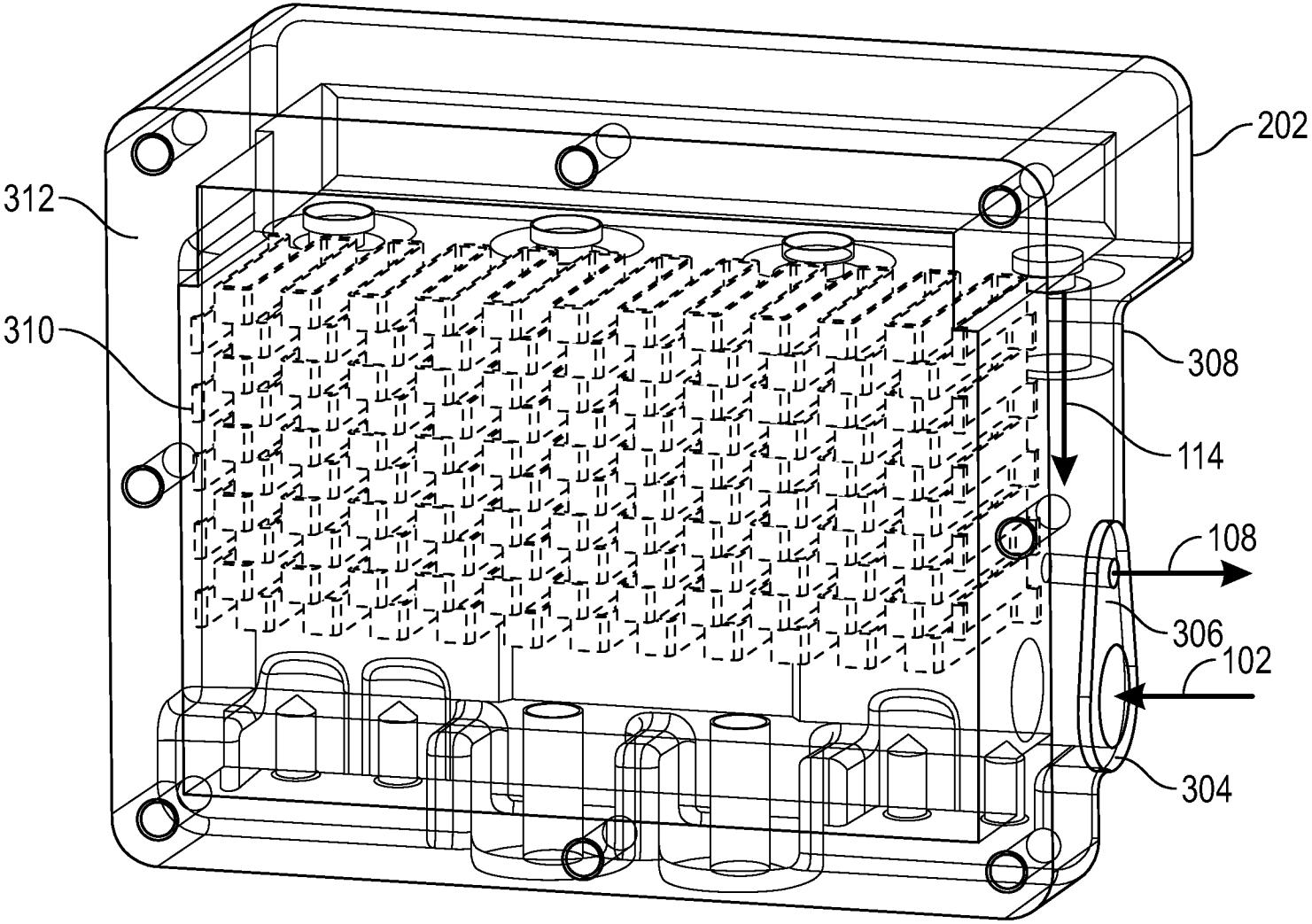
FIG. 3D illustrates a partially-open rear view of the fuel rail attenuating volume illustrated in FIG. 3A.

FIG. 3C illustrates a covered rear view of the fuel rail attenuating volume illustrated in FIG. 3A. FIG. 3D illustrates a partially-open rear view of the fuel rail attenuating volume illustrated in FIG. 3A.

As illustrated in FIG. 3C, a side wall (SW) 312 is illustrated with a flow path (FP) 314 via which the CLI 104 flows through the HFRAV 202 and the CLO 108 is output from the HFRAV 202. The FP 314 may be part of the SW 312, or the FP 314 may be part of the H2 fuel manifold with the H2 fuel manifold attached to a side wall of the chamber. As illustrated in FIG. 3D, the FN 310 are provided in the HFRAV 202 and the NH2 114 is output from the HFRAV 202.

Figure 3E:
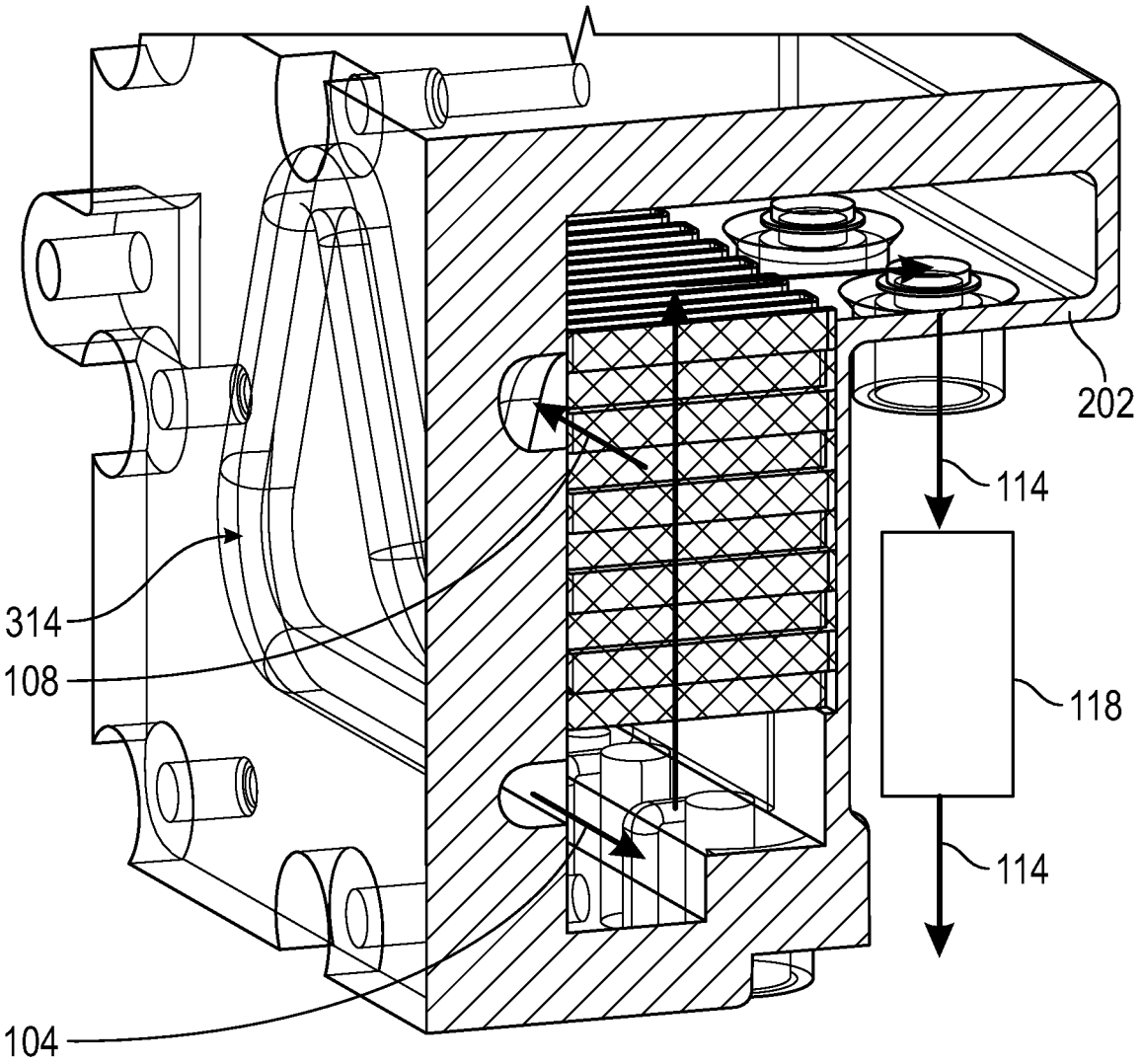
FIG. 3E illustrates a partially-open side view of the fuel rail attenuating volume illustrated in FIG. 3A.

FIG. 3E illustrates a partially-open side and rear view of the fuel rail attenuating volume illustrated in FIG. 3A. As illustrated in FIG. 3E, the path of the CH2 102 (PCH2) 316 is illustrated by the arrow through the HFRAV 202 with the NH2 114 output to the INJ 118 with the NH2 114 output from the INJ 118 to the FCS 120.

The detailed disclosure and the drawings are supportive and descriptive of the present disclosure, but the scope of the present disclosure is defined solely by the appended claims. While some of the best modes and other embodiments for carrying out the present disclosure have been disclosed in detail, various alternative designs and embodiments exist for practicing the present disclosure as recited in the appended claims. Moreover, the present disclosure expressly includes combinations and sub-combinations of the elements and features disclosed herein.

Aspects of the present disclosure have been presented in general terms and in detail with reference to the illustrated embodiments. Various modifications may be made by those skilled in the art without departing from the scope and spirit of the disclosed embodiments. One skilled in the relevant art will also recognize that the disclosed methods and supporting hardware implementations may be alternatively embodied in other specific forms without departing from the scope of the present disclosure. Therefore, the present disclosure is intended to be illustrative without limiting the inventive scope defined solely by the appended claims.

For purposes of the present disclosure, unless specifically disclaimed, use of the singular includes the plural and vice versa, the terms "and" and "or" shall be both conjunctive and disjunctive, and the words "including", "containing", "comprising", "having", and similar terms shall mean "including without limitation." Moreover, words of approximation such as "about," "almost," "substantially," "generally," "approximately," etc., may be used herein in the sense of "at, near, or nearly at," or "within 0-5% of," or "within acceptable manufacturing tolerances," or logical combinations thereof.

As used herein, a component that is "configured to" perform a specified function is capable of performing the specified function without alteration, rather than merely having potential to perform the specified function after further modification. In other words, the disclosed hardware, when expressly configured to perform the specified function, is specifically selected, created, implemented, utilized, programmed, and/or designed for the purpose of performing the specified function.

The terminology used herein is for the purpose of disclosing particular example embodiments and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, elements, compositions, steps, integers, operations, and/or components, but do not preclude the presence or addition of one or more other features, integers, steps, operations, elements, components, and/or groups thereof.

Although the open-ended term "comprising," is to be understood as a non-restrictive term used to disclose and claim various embodiments set forth herein, in certain aspects, the term may alternatively be understood to instead be a more limiting and restrictive term, such as "consisting of" or "consisting essentially of" Thus, for a given embodiment reciting compositions, materials, components, elements, features, integers, operations, and/or process steps, the present disclosure also specifically includes embodiments consisting of, or consisting essentially of, such recited compositions, materials, components, elements, features, integers, operations, and/or process steps.

In the case of "consisting of," the alternative embodiment excludes additional compositions, materials, components, elements, features, integers, operations, and/or process steps, while in the case of "consisting essentially of," additional compositions, materials, components, elements, features, integers, operations, and/or process steps that materially affect the basic and novel characteristics are excluded from such an embodiment, but compositions, materials, components, elements, features, integers, operations, and/or process steps that do not materially affect the basic and novel characteristics may be included in the embodiment.

Method steps, processes, and operations disclosed herein are not to be construed as necessarily requiring their performance in the particular order discussed or illustrated, unless specifically identified as an order of performance. It is also to be understood that additional or alternative steps may be employed, unless otherwise indicated.

When a component, element, or layer is referred to as being "on," "engaged to," "connected to," or "coupled to" another element or layer, it may be directly on, engaged, connected or coupled to the other component, element, or layer, or intervening elements or layers may be present. In contrast, when an element is referred to as being "directly on," "directly engaged to," "directly connected to," or "directly coupled to" another element or layer, there may be no intervening elements or layers present. Other words used to disclose the relationship between elements should be interpreted in a like fashion (e.g., "between" versus "directly between," "adjacent" versus "directly adjacent," etc.). As used herein, the term "and/or" includes combinations of one or more of the associated listed items.

Although the terms first, second, third, etc. may be used herein to disclose various steps, elements, components, regions, layers and/or sections, these steps, elements, components, regions, layers and/or sections should not be limited by these terms, unless otherwise indicated. These terms may be used to distinguish one step, element, component, region, layer or section from another step, element, component, region, layer or section. Terms such as "first," "second," and other numerical terms when used herein do not imply a sequence or order unless clearly indicated by the context. Thus, a first step, element, component, region, layer or section disclosed herein could be termed a second step, element, component, region, layer or section without departing from the teachings of the example embodiments.

Spatially or temporally relative terms, such as "before," "after," "inner," "outer," "beneath," "below," "lower," "above," "upper," and the like, may be used herein to disclose one element or feature's relationship to another element(s) or feature(s) as illustrated in the figures. Spatially or temporally relative terms may be intended to encompass different orientations of the device or system in use or operation in addition to the orientation depicted in the figures.

Throughout this disclosure, the numerical values represent approximate measures or limits to ranges to encompass minor deviations from the given values and embodiments having about the value mentioned as well as those having exactly the value mentioned. Other than in the working examples provided at the end of the detailed disclosure, numerical values of parameters (e.g., of quantities or conditions) in this specification, including the appended claims, are to be understood as being modified by the term "about" or "approximately" regardless of whether "about" or "approximately" actually appears before the numerical value. In addition, disclosure of ranges includes disclosure of values and further divided ranges within the entire range, including endpoints and sub-ranges given for the ranges.

The word "about" or "approximately" indicates that the stated numerical value allows some slight imprecision (with some approach to exactness in the value; approximately or reasonably close to the value; nearly). If the imprecision provided by "about" or "approximately" is not otherwise understood in the art with this ordinary meaning, then "about" or "approximately" as used herein indicates at least variations that may arise from ordinary methods of measuring and using such parameters. For example, "about" or "approximately" may comprise a variation of less than or equal to 5%, optionally less than or equal to 4%, optionally less than or equal to 3%, optionally less than or equal to 2%, optionally less than or equal to 1%, optionally less than or equal to 0.5%, and in certain aspects, optionally less than or equal to 0.1%.

What is claimed is:

1. A multi-function fuel delivery system, comprising:

a hydrogen (H2) heat exchanger receiving cold H2 and performing an H2 fuel heating function thereon, thereby producing heated H2;

an H2 fuel manifold in which the H2 heat exchanger is housed, the H2 manifold being configured to receive the heated H2 that is heated by the H2 heat exchanger and performing an H2 fuel noise/vibration attenuating function thereon to reduce vibration noise, thereby producing noise-attenuated H2; and a fuel rail configured to receive the noise-attenuated H2 from the H2 fuel manifold and provide the noise-attenuated H2 simultaneously to a plurality of injectors, wherein:

the H2 fuel manifold comprises at least one coolant flow path providing heat to at least one heat-transfer core; and the H2 heat exchanger, the H2 fuel manifold, and the fuel rail are housed in a single chamber.

2. The fuel delivery system of claim 1, further comprising a plurality of modular heat-transfer cores, wherein a number and layout of the plurality of modular heat-transfer cores is variable to provide different amounts of heat transfer.

3. The fuel delivery system of claim 2, wherein the plurality of modular heat-transfer cores each comprise a plurality of variable modular fins configured to provide the different amounts of heat transfer; and the at least one coolant flow path has variable dimensions configured to provide the different amounts of heat transfer.

4. The fuel delivery system of claim 1, wherein the at least one coolant flow path is geometrically shaped for optimized performance to enhance heat transfer of coolant to the H2 heat exchanger.

5. The fuel delivery system of claim 1, wherein the at least one coolant flow path is included in a side wall of the chamber.

6. The fuel delivery system of claim 1, wherein:

the at least one coolant flow path is included in the H2 fuel manifold; and the H2 fuel manifold is attached to a side wall of the chamber.

7. The fuel delivery system of claim 1, wherein the H2 heat exchanger comprises a cold/hot plate to perform the heating/cooling function.

8. The fuel delivery system of claim 1, wherein the fuel delivery system is a heated fuel rail attenuating volume (HFRAV).

9. The fuel delivery system of claim 1, wherein a heating/cooling capacity of the H2 heat exchanger is independent of a noise/vibration attenuating capacity of the H2 fuel manifold.

10. The fuel delivery system of claim 1, wherein a noise/vibration attenuating volume of the H2 fuel manifold is shared with an H2 heat-transfer flow field of flow channels for heat transfer.

11. A method of providing fuel delivery, the method comprising:

receiving cold hydrogen (H2) and performing an H2 heating function thereon, thereby producing heated H2;

performing an H2 fuel noise/vibration attenuating function on heated H2 to reduce vibration noise, thereby producing noise-attuned H2;

providing heat to a heat-transfer core via at least one coolant flow path; and providing the noise-attenuated H2 simultaneously to a plurality of injectors, wherein the H2 fuel heating/cooling function, the H2 fuel noise/vibration attenuating function, providing the heat to the heat-transfer core, and providing the noise-attenuated H2 are performed in a single chamber.

12. The method of claim 11, further comprising varying a number and layout of a plurality of modular heat-transfer cores to provide different amounts of heat transfer.

13. The method of claim 12, wherein providing the different amounts of heat transfer comprises:

varying a number of a plurality of modular fins; and varying dimensions of the at least one coolant flow path to provide the different amounts of heat transfer.

14. The method of claim 11, wherein the at least one coolant flow path is geometrically shaped for optimized performance to enhance heat transfer of coolant to the H2 fuel manifold.

15. The method of claim 14, further comprising providing the at least one coolant flow path in a side wall of the chamber.

16. The method of claim 11, further comprising providing the at least one coolant flow path in an H2 fuel manifold that is attached to a side wall of the chamber.

17. The method of claim 11, wherein the H2 heating/cooling function comprises controlling a cold/hot plate.

18. The method of claim 11, wherein the H2 heating/cooling function is performed independent of the noise/vibration attenuating function.

19. The method of claim 11, wherein the noise/vibration attenuating function shares an H2 heat-transfer flow field of flow channels for heat transfer.

20. A multi-function fuel delivery system, the fuel delivery housed in a single chamber and comprising:

a hydrogen (H2) heat exchanger configured to receive cold H2 and performing an H2 fuel heating function thereon, thereby producing heated H2;

an H2 fuel manifold in which the H2 heat exchanger is housed, and configured to receive the heated H2 that is heated by the H2 heat exchanger and perform an H2 fuel noise/vibration attenuating function to reduce vibration noise, thereby producing noise-attuned H2;

a fuel rail receiving the noise-attenuated H2 from the H2 fuel manifold and provide the noise-attenuated H2 simultaneously to a plurality of injectors; and a plurality of modular heat-transfer cores, wherein:

the H2 fuel manifold comprises at least one coolant flow path and configured to provide heat to the plurality of modular heat-transfer cores;

a number and layout of the plurality of modular heat-transfer cores is variable to provide different amounts of heat transfer;

the plurality of modular heat-transfer cores each comprise a plurality of variable modular fins to provide the different amounts of heat transfer; and the H2 heat exchanger, the H2 fuel manifold, and the fuel rail are housed in a single chamber.

* * * * *